US008413825B2

(12) United States Patent
Spizman et al.

(10) Patent No.: US 8,413,825 B2
(45) Date of Patent: Apr. 9, 2013

(54) GONDOLA GRAVITY FEED RETROFIT SHELVING

(76) Inventors: Robert Spizman, Highland Park, IL (US); Raul Romeiro, West Chester, OH (US); Brian Herres, Naperville, IL (US)

( * ) Notice: Subject to any disclaimer, the term of this patent is extended or adjusted under 35 U.S.C. 154(b) by 233 days.

(21) Appl. No.: 12/916,724

(22) Filed: Nov. 1, 2010

(65) Prior Publication Data

US 2011/0100942 A1 May 5, 2011

Related U.S. Application Data

(60) Provisional application No. 61/256,500, filed on Oct. 30, 2009.

(51) Int. Cl.
*A47F 5/00* (2006.01)

(52) U.S. Cl.
USPC ..... 211/184; 211/150

(58) Field of Classification Search ..... 211/150, 211/59.2, 184, 187, 103, 190, 90.02, 193; 248/241–243; 312/60, 61
See application file for complete search history.

(56) References Cited

U.S. PATENT DOCUMENTS 3,145,850 A * 8/1964 Ciborowski ..... 211/133.5
3,490,600 A * 1/1970 Reed et al. ..... 248/220.41
5,117,986 A * 6/1992 Lin ..... 211/90.02
5,119,945 A * 6/1992 Wiggins ..... 211/59.2
5,738,019 A * 4/1998 Parker ..... 108/108
5,816,419 A * 10/1998 Lamson ..... 211/150
6,041,720 A * 3/2000 Hardy ..... 108/60
6,168,032 B1 * 1/2001 Merl ..... 211/59.2
6,234,328 B1 * 5/2001 Mason ..... 211/90.02
6,302,282 B1 * 10/2001 Gay et al. ..... 211/153
6,398,044 B1 * 6/2002 Robertson ..... 211/59.2
7,048,131 B2 * 5/2006 Gay et al. ..... 211/187
7,896,171 B2 * 3/2011 Battaglia ..... 211/59.2
2002/0027115 A1 * 3/2002 Gay et al. ..... 211/187
2003/0141265 A1 * 7/2003 Jo et al. ..... 211/59.3
2004/0050811 A1 * 3/2004 Leahy et al. ..... 211/134
2004/0099619 A1 * 5/2004 Bustos ..... 211/59.2
2004/0256341 A1 * 12/2004 Donnell et al. ..... 211/187
2006/0096938 A1 * 5/2006 Kanou ..... 211/184

* cited by examiner

*Primary Examiner* — Jennifer E. Novosad
(74) *Attorney, Agent, or Firm* — Dinsmore & Shohl LLP

(57) ABSTRACT

Retrofitting shelves attachable to a shelving system, shelving systems, and methods of displaying items on a shelving system. In one form, the retrofitting shelf includes a supporting unit, pivoting mechanisms attachable to the supporting unit, and a continuously adjustable device for dividing items on the shelving system which is attachable to the supporting unit. In another form, the shelving system includes a base, vertical members attached to the base, and a retrofitting shelf attached to the vertical members. In yet another form, the method for displaying items on a shelving system includes attaching a retrofitting shelf to the shelving system and placing items on the supporting unit of the retrofitting shelf.

20 Claims, 8 Drawing Sheets

GONDOLA GRAVITY FEED RETROFIT SHELVING

This application claims priority to U.S. Provisional Application Ser. No. 61/256,500, filed Oct. 30, 2009, the contents of which are hereby incorporated by reference in its entirety.

TECHNICAL FIELD

The present invention is generally directed to a shelf for a shelving system, and more specifically to a retrofitting shelf for a shelving system.

BACKGROUND

In a retail environment, it is advantageous to display merchandise in such a way that it is easy for a customer to both visually identify and retrieve a desired product from the shelf upon which the product is stored and displayed. Retail stores commonly display their products in a vertically standing display rack or related assembly known as gondola shelving. In one popular form, gondola shelving is assembled in a back-to-back configuration such that customer aisles are formed to permit the display of merchandise on both sides of the aisle. Such display configurations are beneficial in that they can be installed to define a variety of floor plan configurations. A further advantage of gondola shelving assemblies is that they may be used in both refrigerated and non-refrigerated display racks.

A typical gondola shelving assembly includes cantilevered shelves that are secured to a generally upright rigid backing through horizontally-spaced vertical standards that include periodically-spaced slots that can accept a rearwardly-protruding detent that is formed in the back of the individual shelves. Conventional gondola structures (including the shelving) require considerable time to assemble, and once assembled, their fixed construction makes it difficult to reconfigure them to accommodate different types of merchandise. For example, once the shelves are mounted to the standards, the spacing between vertically adjacent shelves is fixed, often to a height greater than that of the product being displayed as well as to any additional distance required to lift the bottom of the product container over the stop. Such a configuration is undesirable, as it decreases the merchandise "packout", defined as the density of merchandise being displayed within a fixed space.

Gondola shelves are commonly sloped toward the customer in a downward direction so that the product is biased by gravity toward the lower forward edge to facilitate consumer access. Such a configuration is known as gravity feed shelving. The gravity feed configuration ensures that once the forwardmost product is removed from the track in the shelf, the remaining containers in that track slide forward under the force of gravity until the next one in line encounters a lip, stop, or related device placed at the front of the shelf to prevent the container from falling out. Another feature of gondola shelving is that the individual shelves are commonly divided into numerous parallel tracks or channels with dividers between them so that the product is partitioned into orderly columns that extend from the back of the shelf to the front. In some circumstances, the placement of the dividers is determined by the shelf manufacturer which may result in inefficient storage and display of the product. In other circumstances, the dividers are adjustably mounted to the shelves using predetermined divider spacing increments (for example, one eighth of an inch). While this latter configuration provides additional flexibility over the fixed variety, they typically necessitate complicated attachment mechanisms, making it difficult to remove and reattach the dividers to the shelf in situations where the retailer may want to reconfigure the display.

Insofar as such dividers may be adjustable, their connection to manufacturer-dictated lateral spacing does not permit incremental variations in shelf or divider placement to accommodate a particular merchandise package. Moreover, many dividers employ inferior material (for example, breakable plastic), making them unsuitable for heavy products, such as detergent, fabric softener, soda bottles or the like. Furthermore, there is no ability to rotate or pivot the shelves about a horizontal axis when mounted which reduces the retailer's ability to accommodate merchandise made from non-standard or different packaging size, as well as to place tall merchandise packages between vertically-adjacent shelves.

As such, there exists a need for shelving for a gravity feed gondola system that avoids the shortcomings of conventional shelving. There further exists a need for such shelving that can be retrofitted onto existing gondola systems so that a user of the system can take advantage of as much existing gondola infrastructure as possible.

SUMMARY

These needs are met by the present invention, where according to one embodiment, a retrofitting shelf attachable to a shelving system is disclosed. The retrofitting shelf comprises a supporting unit attachable to the shelving system, a plurality of pivoting mechanisms attachable to the supporting unit, and at least one continuously adjustable device for dividing items on the shelving system. The plurality of pivoting mechanisms provide selective rotation of the supporting unit. The one or more continuously adjustable devices for dividing items on the shelving system are attachable to the supporting unit such that the items on the shelving system may be adjustably divided.

Optionally, the supporting unit of the retrofitting shelf may comprise a support plate having a front surface substantially parallel to a back surface, and a pair of side surfaces substantially parallel to one another, wherein the front surface and the back surface are substantially normal to the pair of side surfaces such that the support plate is substantially rectangular, a plurality of mounting brackets integral with the pair of side surfaces of the support plate, a stopper member integral with the front surface of the support plate, and a plurality of attachment members integral with the front surface and the back surface of the support plate.

Optionally, the plurality of pivoting mechanisms are attachable to the plurality of mounting brackets. The plurality of pivoting mechanisms may provide selective rotation of the supporting unit such that the support plate selectively rotates from about 0° to about 20°.

Optionally, the at least one continuously adjustable device for dividing items on the shelving system may optionally comprise a dividing member terminating in respective ends thereof and a pair of guide members. The guide members may comprise an engaging member defining one or more channels through which the respective ends of the dividing member are engageable with the engaging member and at least one of a substantially arcuate-shaped member integral with the engaging member and a substantially wedge-shaped member integral with the engaging member, wherein the at least one of the substantially arcuate-shaped member and the substantially wedge-shaped member are attachable to the supporting unit.

Optionally, the engaging member may be substantially normal to one or both of the substantially arcuate-shaped member and the substantially wedge-shaped member. The cross-sectional shape of the channel or channels may be substantially circular and the cross-sectional shape of the dividing member may be substantially circular. The respective ends may be engageable with the engaging member through the channel via frictional fit mechanism.

Optionally, at least one of the substantially arcuate-shaped member and the substantially wedge-shaped member are attachable to the supporting unit via the plurality of attachment members of the supporting unit. The substantially arcuate-shaped member may be attachable to the supporting unit via the plurality of attachment members with a snap-fit mechanism. The substantially wedge-shaped member may be attachable to the supporting unit via the plurality of attachment members with a frictional fit mechanism.

According to another embodiment of the present invention, a shelving system is disclosed. The shelving system comprises a base, a plurality of substantially vertical members attached to the base, and at least one retrofitting shelf attached to the plurality of substantially vertical members. The shelf comprises a supporting unit and at least one continuously adjustable device for dividing items on the shelving system, wherein the continuously adjustable device is attachable to the supporting unit such that the items on the shelving system may be adjustably divided.

Optionally, the supporting unit is as described according to the previous embodiments. The supporting unit may further comprise a plurality of pivoting mechanisms as described according to the previous embodiments. The continuously adjustable device for dividing items on the shelving system is as described according to the previous embodiments.

According to yet another embodiment of the present invention, a method of displaying items on a shelving system is disclosed. The method comprises attaching a retrofitting shelf to the shelving system and placing items on the supporting unit of the retrofitting shelf, such that the items are displayed. The retrofitting shelf is as described according to the previous embodiments.

These and other features and advantages of these and other various embodiments according to the present invention will become more apparent in view of the drawings, detailed description, and claims provided that follow hereafter.

BRIEF DESCRIPTION OF THE DRAWINGS

The following detailed description of the embodiments of the present invention can be best understood when read in conjunction with the following drawings, where like structure is indicated with like reference numerals, and in which.

Skilled artisans appreciate that elements in the figures are illustrated for simplicity and clarity and have not necessarily been drawn to scale. For example, the dimensions of some of the elements in the figures may be exaggerated relative to other elements, as well as conventional parts removed, to help to improve understanding of the various embodiments of the present invention.

DETAILED DESCRIPTION

As used herein, the term "retrofitting shelf" refers to a shelf which fits in or on an existing shelving structure and/or system. For example, in one particular embodiment, the term retrofitting shelf refers to a shelf which fits in or on an existing gondola shelving structure and/or system.

As used herein, the term "continuously adjustable device" refers to a device which is attachable to a structure at continuously variable points along the structure. For example, in one particular embodiment, the term continuously adjustable device refers to a device for dividing items on a shelving system, wherein the device is attachable at continuously variable points along the length of a retrofitting shelf.

Figure 1A:
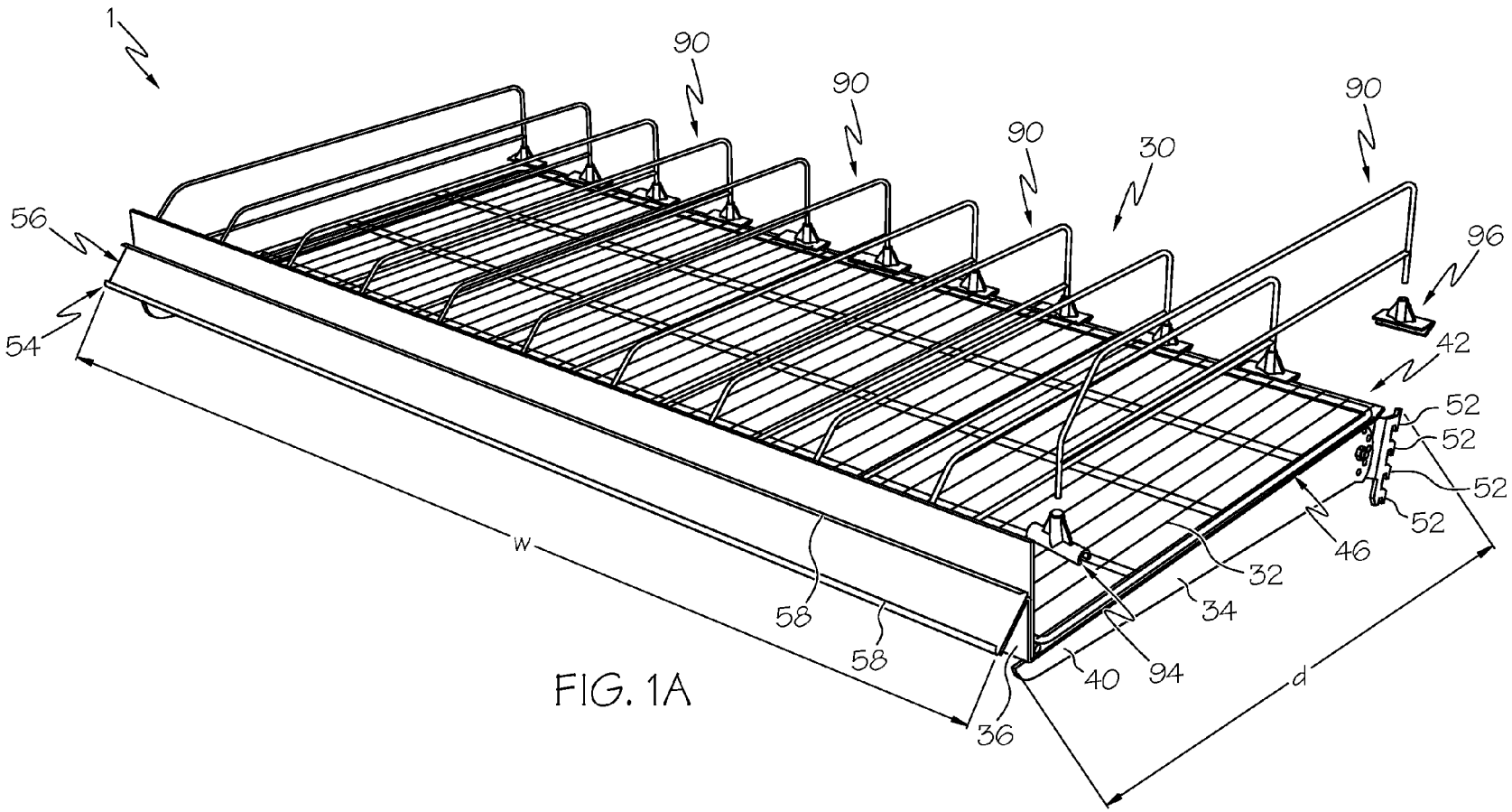
FIG. 1A is a front perspective view of a retrofitting shelf according to an embodiment of the present invention.
Figure 1B:
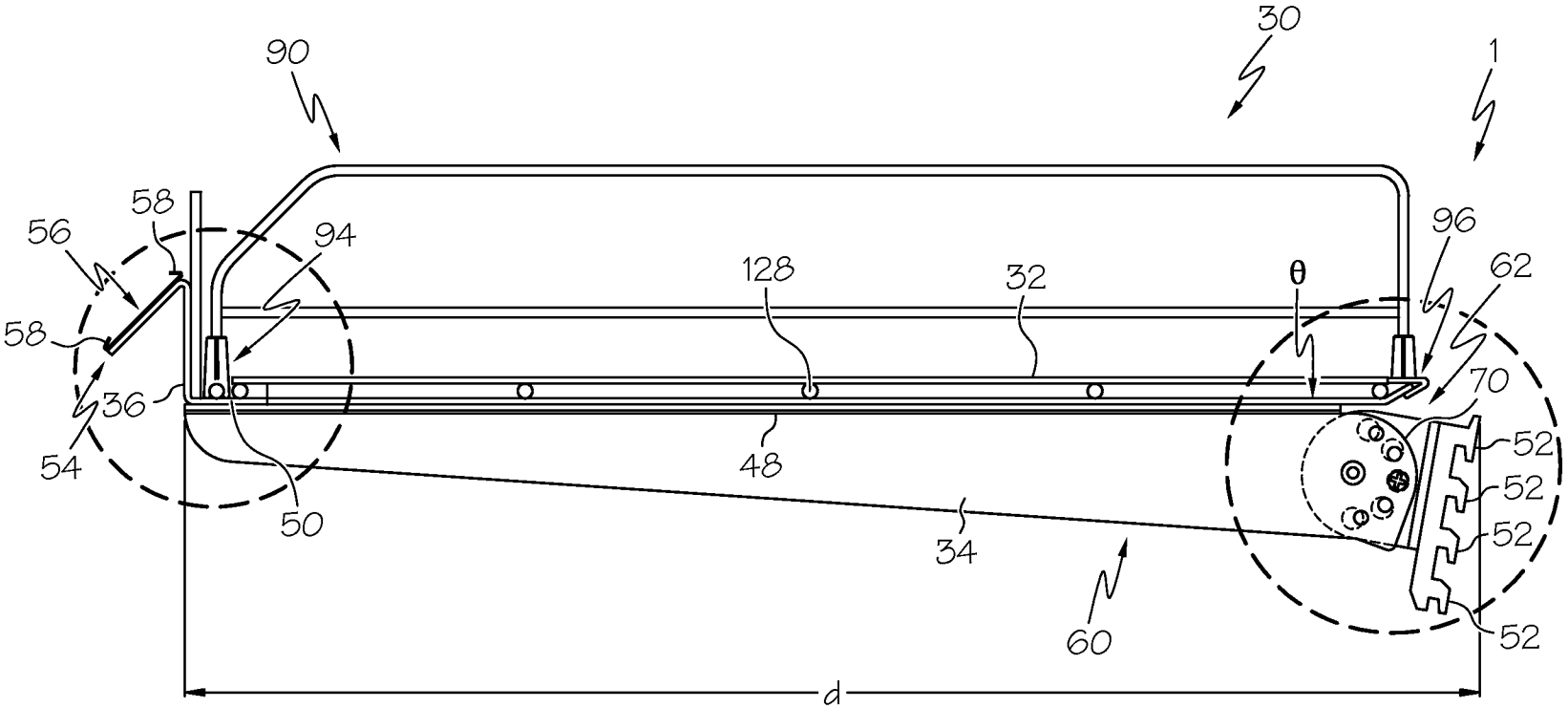
FIG. 1B is a side view of a retrofitting shelf according to an embodiment of the present invention.

As shown in FIGS. 1A and 1B, in one aspect, a retrofitting shelf 1 attachable to a shelving system 130 is disclosed. In one embodiment, the retrofitting shelf 1 may comprise a supporting unit 30, a plurality of pivoting mechanisms 70 attachable to the supporting unit 30, and at least one continuously adjustable device 90 for dividing items on the shelving system 130. In one particular embodiment, the supporting unit 30 is attachable to the shelving system 130 and may comprise a support plate 32, a plurality of mounting brackets 34, a stopper member 36, and a plurality of attachment members 38.

Figure 1D:
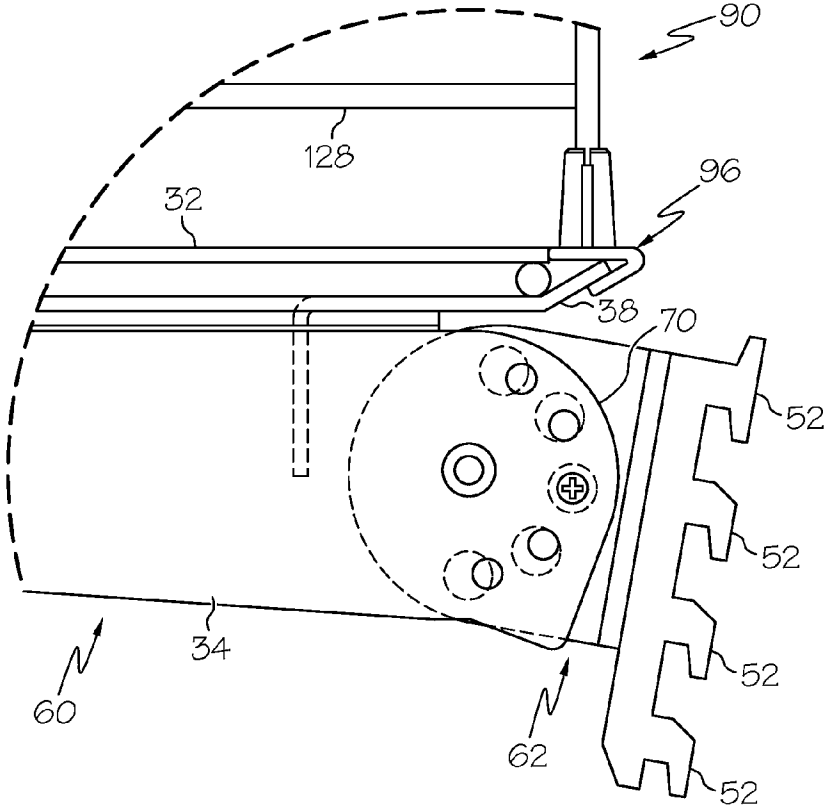
FIG. 1D is a partial side view of the back portion of the retrofitting shelf of FIG. 1B, wherein the pivoting mechanism is shown in accordance with an embodiment of the present invention.
Figure 1C:
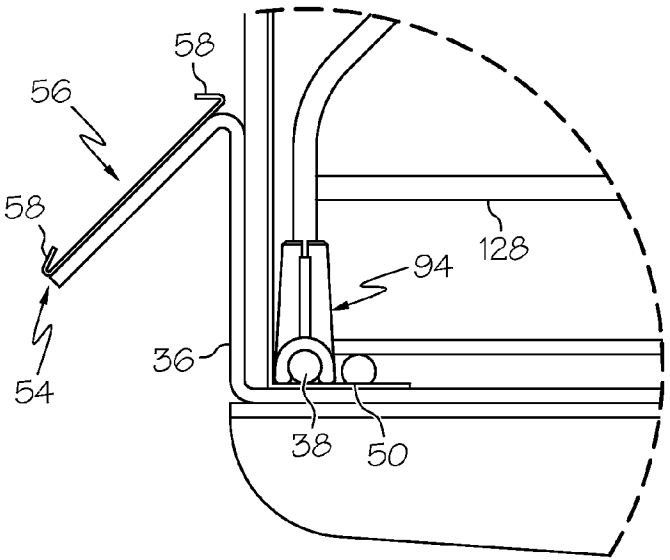
FIG. 1C is a partial side view of the front portion of the retrofitting shelf of FIG. 1B according to an embodiment of the present invention.
Figure 1E:
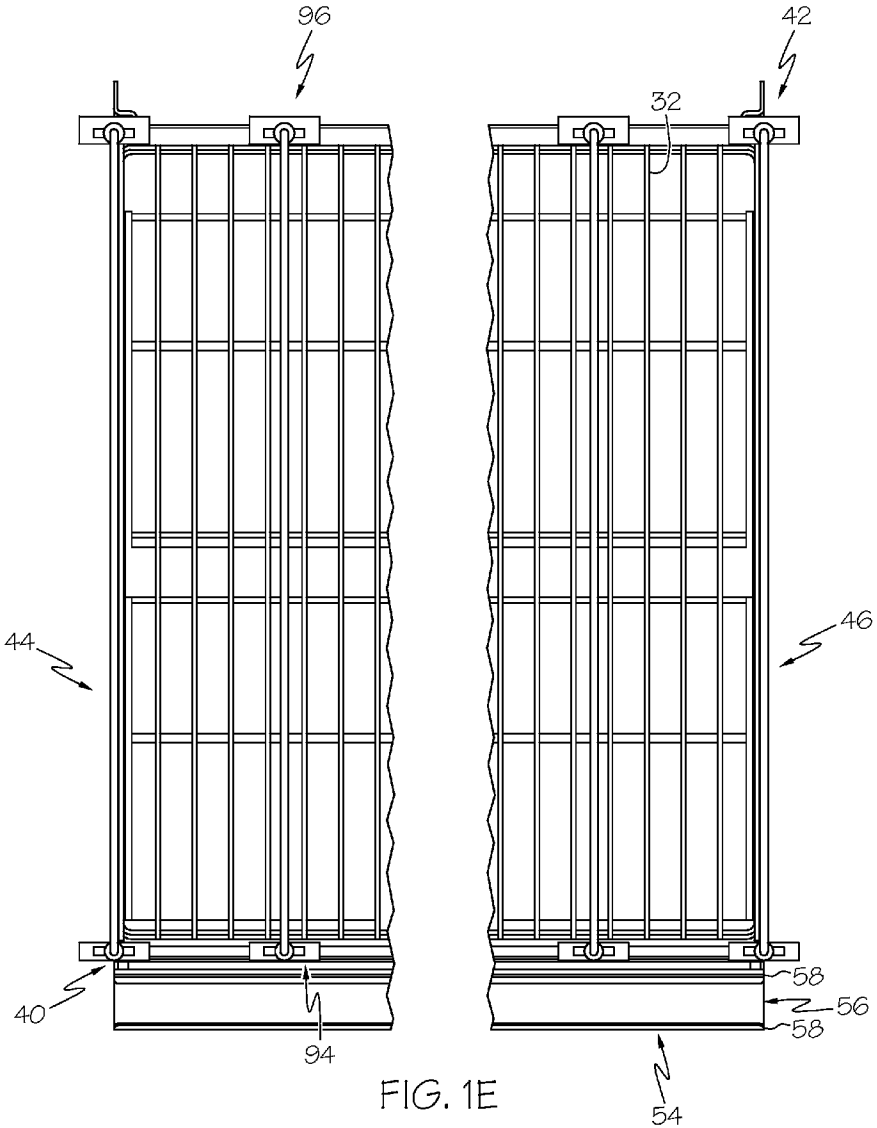
FIG. 1E is a top view of the retrofitting shelf in accordance with an embodiment of the present invention.

Referring to FIG. 1E in conjunction with FIG. 1A, in one embodiment, the supporting unit 30 may comprise a support plate 32 having a front surface 40, a back surface 42, and a pair of side surfaces 44, 46. In one particular embodiment, the front surface 40 is substantially parallel to the back surface 42, the pair of side surfaces 44, 46 are substantially parallel to one another, and the front surface 40 and the back surface 42 are substantially normal to the pair of side surfaces 44, 46 such that the support plate 32 is substantially rectangular. The shape of the support plate 32 should not be limited to substantially rectangular, however, but may comprise any shape such that the retrofitting shelf 1 is attachable to and fits in or on the shelving system 130.

In another embodiment, the support plate 32 may comprise a grid-like structure. In one particular embodiment, the support plate 32 may comprise a wire grid-like structure. In another particular embodiment, the support plate 32 may be approximately 48 inches wide and approximately 25 inches deep. The dimensions of the width and/or depth (as shown by double arrows w and d, respectively) of the support plate 32 should not be limited to those disclosed herein, however, but may comprise any width and/or depth such that the retrofitting shelf 1 is attachable to and fits in or on the shelving system 130.

The support plate 32 may be provided at an acute angle θ such that the support plate 32 is sloped in a substantially downward direction toward the front of the shelving system 130. In one particular embodiment, the support plate 32 may be provided at an acute angle θ ranging from about 7° to about 13°, and alternatively from about 7° to about 10°, which could correspond to the placement of the holes on the pivoting mechanism 70, as shown in FIGS. 1B and 1D. In this embodiment, the support plate 32 provides a gravity feed configuration such that when an item is removed from the support plate 32, the remaining items behind the removed item slide forward under the force of gravity. The support plate 32 may be made from any structurally suitable material, including plastics, metals, composites or the like. In one embodiment, the support plate 32 comprises metal wire.

As shown with particularity in FIG. 1B, the support plate 32 may further comprise at least one support bar 48. In one embodiment, the support bar 48 may comprise a substantially elongate shape. In another embodiment, the support bar 48 may be integral with the support plate 32. Alternatively, the support bar 48 may be attached to the support plate 32. In one embodiment, the support bar 48 may extend substantially along the width of the support plate 32. In one particular embodiment, the support bar 48 may extend substantially along the width of the support plate 32 across the center of the support plate 32. In one particular embodiment, the support bar 48 may extend along substantially all of the width of the support plate 32. Alternatively, the support bar 48 may extend along a portion of the width of the support plate 32. The positioning of the support bar 48 should not be limited to that described herein, however, but may be positioned in any manner such that the support bar 48 provides additional support to the support plate 32. The support bar 48 may be made from any structurally suitable material, including plastics, metals, composites or the like.

Referring to FIGS. 1A-1D, in another embodiment, the supporting unit 30 may comprise a plurality of mounting brackets 34. In one particular embodiment, the mounting brackets 34 may be integral with the pair of side surfaces 44, 46 of the support plate 32. Alternatively, the mounting brackets 34 may be attached to the pair of side surfaces 44, 46 of the support plate 32. In one particular embodiment, the mounting brackets 34 may extend along substantially all of the depth of the support plate 32. Alternatively, the mounting brackets 34 may extend along a portion of the width of the support plate 32. In another embodiment, the mounting brackets 34 may provide detents 52. The detents 52 may extend outwardly from the back of the supporting unit 30 such that the detents 52 may engage the shelving system 130. In this way, the supporting unit 30 may be attached to the shelving system 130. In another embodiment, the mounting brackets 34 may be made from any structurally suitable material, including plastics, metals, composites or the like.

In another embodiment, the supporting unit 30 may comprise a stopper member 36. In one particular embodiment, the stopper member 36 may be integral with the front surface 40 of the support plate 32. Alternatively, the stopper member 36 may be attached to the front surface 40 of the support plate 32. The stopper member 36 may prevent items on the supporting unit 30 from falling off of the supporting unit 30. In one particular embodiment wherein the support plate 32 is provided at an acute angle θ such that the support plate 32 is sloped in a substantially downward direction, the stopper member 36 may prevent items which slide forward under the force of gravity from falling off of the supporting unit 30.

Stopper member 36 may extend substantially along the front surface 40 of the support plate 32 in a direction substantially normal to or slightly less than normal to the support plate 32. The positioning of the stopper member 36 should not be limited to substantially along the front surface 40 of the support plate 32, however, but may comprise any position such that the stopper member 36 prevents items from falling off of the supporting unit 30. In another embodiment, the stopper member 36 may be made from any structurally suitable material, including plastics, metals, composites or the like.

In another embodiment, the stopper member 36 may further comprise at least one display member 54. In one embodiment, the display member 54 may comprise a substantially elongate shape. In another embodiment, the display member 54 may comprise a substantially elongate shape which defines a channel 56 for displaying signage and/or tickets therein. In a further embodiment, the display member 54 may comprise at least one tab member 58 for releasably holding the signage and/or tickets. In one particular embodiment, the display member 54 may be integral with the stopper member 36. Alternatively, the display member 54 may be attached to the stopper member 36. In one particular embodiment, the display member 54 may extend substantially along the stopper member 36. Alternatively, the display member 54 may extend along a portion of the stopper member 36. In this particular embodiment, the display member 54 may form an acute angle τ with the stopper member 36.

The display member 54 may display signage and/or tickets. In one embodiment, the display member 54 may display signage and/or tickets wherein the signage and/or tickets slidably engage the channel 56 defined by the display member 54. In a further embodiment, the tab member 58 may releasably hold the signage and/or tickets displayed within the channel 56 such that the signage and/or tickets do not fall out of the display member 54. The signage and/or tickets may comprise text, graphics, images, and/or advertisements. In another embodiment, the display member 54 may be made from an optically-transparent material.

In another embodiment, the support unit 30 may further comprise at least one shield member 50. In one embodiment, the shield member 50 may comprise a substantially elongate shape. In one particular embodiment, the shield member 50 may be integral with the stopper member 36. The shield member 50 may extend substantially along the front surface 40 of the support plate 32 in a direction substantially parallel to the support plate 32. In another embodiment, the shield member 50 may extend substantially along the front surface 40 of the support plate 32 in a direction substantially parallel to the support plate 32 such that the shield member 50 extends in between the front surface 40 of the support plate 32 and the stopper member 36. In one particular embodiment, the front surface 40 of the support plate 32 may extend over a portion of the shield member 50, such that the support plate 32 overlaps with the shield member 50. In this particular embodiment, the front surface 40 of the support plate 32 may overlap with the shield member 50 such that the front surface 40 of the support plate 32 is positioned on top of the shield member 50. In this way, the shield member may form the base for the display member 54.

In another embodiment, the supporting unit 30 may comprise a plurality of attachment members 38. In one embodiment, the attachment members 38 may comprise a substantially cylindrical shape. Alternatively, the attachment members 38 may comprise a substantially elongate shape. The shapes of the attachment members 38 should not be limited to those disclosed herein, however, but may comprise any shape such that the attachment members 38 provide surfaces wherein the continuously adjustable device 90 for dividing items is attachable to the supporting unit 30. In one particular embodiment, the attachment members 38 may be integral with the back surface 42 of the support plate 32. Alternatively, the attachment members 38 may be attached to the front surface 40 and the back surface 42 of the support plate 32. In one embodiment, the attachment members 38 may extend substantially along the front surface 40 and the back surface 42 of the support plate 32. In one particular embodiment, the attachment member 38 extending substantially along the front surface 40 of the support plate 32 is positioned on top of the shield member 50.

The attachment members 38 provide surfaces wherein the continuously adjustable device 90 for dividing items is attachable to the supporting unit 30. In one particular embodiment, the attachment members 38 provide surfaces wherein the continuously adjustable device 90 for dividing items is attachable at continuously variable points along the length of the attachment members 38. More particularly, the attachment members 38 provide surfaces wherein the continuously adjustable device 90 for dividing items is attachable at any point along the length of the attachment members 38. As with many of the other components described herein, the attachment members 38 may be made from any structurally suitable material, including plastics, metals, composites or the like.

As shown with particularity in FIGS. 1B and 1D, in another embodiment, the retrofitting shelf 1 may comprise a plurality of pivoting mechanisms 70 attachable to the supporting unit 30 and to the mounting brackets 34 so that they permit varying angular positioning of the mounting brackets 34 relative to the supporting unit 30. In one particular embodiment wherein the pivoting mechanisms 70 may be attached to the mounting brackets 34, the mounting brackets 34 may comprise a pivoting portion 60 dynamically attached to a fixed portion 62. In this particular embodiment, the pivoting portion 60 may pivot about its dynamic attachment to the fixed portion 62 of the mounting brackets 34. In one embodiment, the pivoting portion 60 of the mounting brackets 34 is integral with or attached to the pair of side surfaces 44, 46 of the support plate 32, such that when the pivoting portion 60 pivots about its dynamic attachment to the fixed portion 62 of the mounting brackets 34, selective rotation of the supporting unit 30 is provided.

The pivoting mechanisms 70 may comprise a ratcheting mechanisms, hinging mechanisms (not shown), and/or pivoting joints (not shown). The ratcheting mechanisms may comprise gears and pawls (not shown). The hinging mechanisms may include but should not be limited to friction hinges, adjustable friction hinges, and lever lock hinges. The pivoting joints may include but should not be limited to U-joints. In one particular embodiment, the pivoting mechanisms 70 may comprise a spring-loaded self-locking pivoting mechanism 70. The pivoting mechanisms 70 should not be limited to the pivoting hinges disclosed herein, however, but may comprise any pivoting mechanisms which provide selective rotation of the supporting unit 30.

In one particular embodiment, the pivoting mechanisms 70 may provide selective rotation of the supporting unit 30 such that the supporting unit 30 selectively rotates from about 0° to about 20°. In a further embodiment, the pivoting mechanisms 70 may provide selective rotation of the supporting unit 30 such that the supporting unit 30 selectively rotates from about 0° to about 20° in about 5° increments. For example, the pivoting mechanisms 70 may provide selective rotation of the supporting unit 30 such that the supporting unit 30 selectively rotates from about 0° to about 5°, from about 5° to about 10°, from about 10° to about 15°, and from about 15° to about 20°, and combinations thereof.

Figure 5:
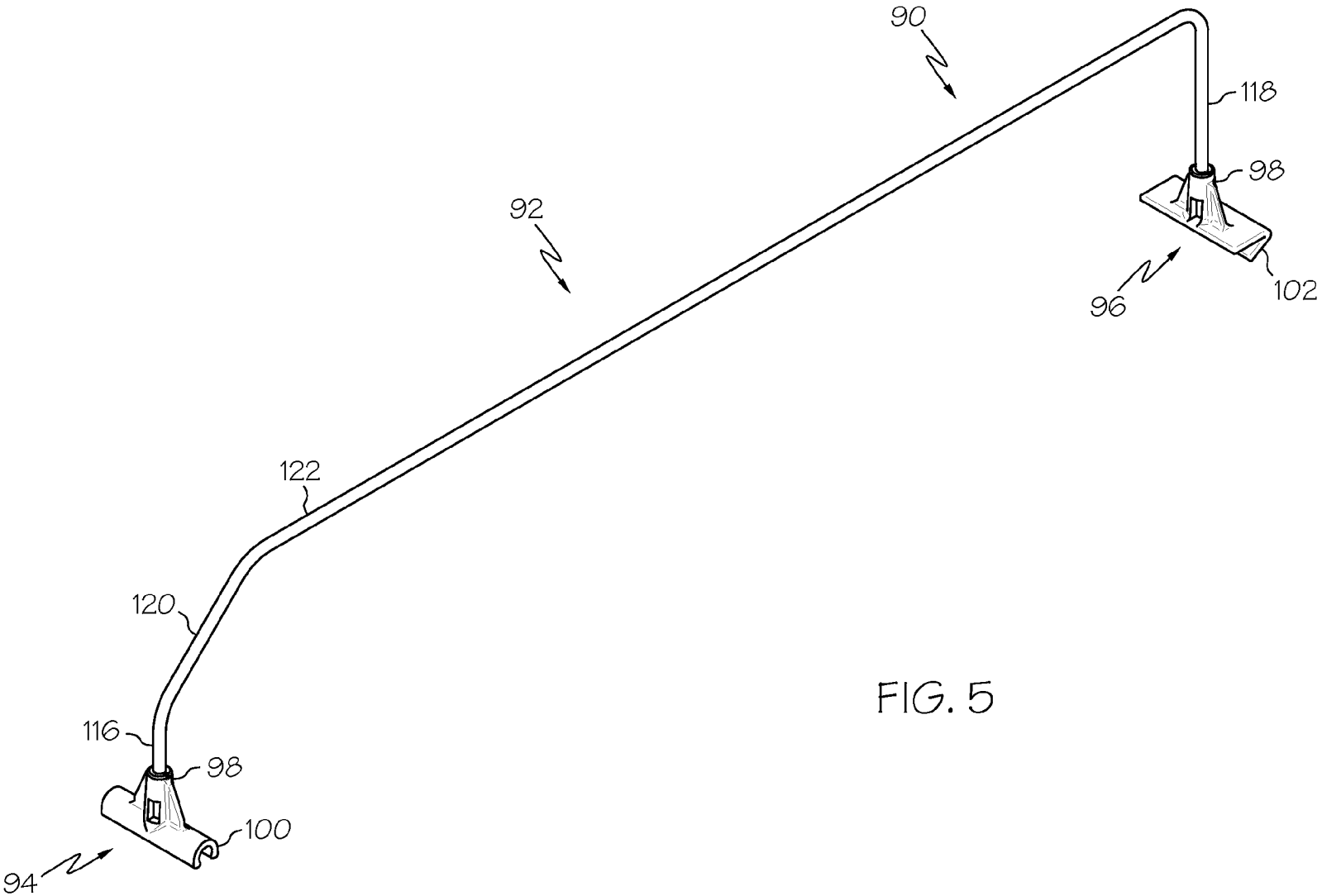
FIG. 5 is a front perspective view of a dividing member according to an embodiment of the present invention.

Referring to FIGS. 1A, 1B, and 5, the retrofitting shelf 1 may comprise at least one continuously adjustable device 90 for dividing items on the shelving system 130. The continuously adjustable device 90 is attachable to the supporting unit 30 such that the items on the shelving system 130 may be adjustably divided. The continuously adjustable device 90 may further comprise a dividing member 92 and a pair of guide members 94, 96. In one particular embodiment, the pair of guide members 94, 96 may comprise an engaging member 98 and at least one of a substantially arcuate-shaped member 100 and a substantially wedge-shaped member 102.

In one embodiment, the dividing member 92 may comprise a substantially bent shape. In this embodiment, the dividing member 92 may comprise a pair of vertical surfaces 116, 118 a bent surface 120, and a horizontal surface 122. In this particular embodiment, one of the vertical surfaces 116 is integral with the bent surface 120, the bent surface is integral with the horizontal surface 122, and the horizontal surface 122 is integral with one of the vertical surfaces 118. In another embodiment, the cross-sectional shape of the dividing member 92 may be substantially circular. In another embodiment, the dividing member 92 may further comprise a support member 128. In one particular embodiment, the support member 128 is integral with and/or attachable to the pair of vertical surfaces 116, 118. The positioning of the support member 128 should not be limited to that disclosed herein, however, but may comprise any position such that the support member 128 provides additional support to the dividing member 92.

Figure 2B:
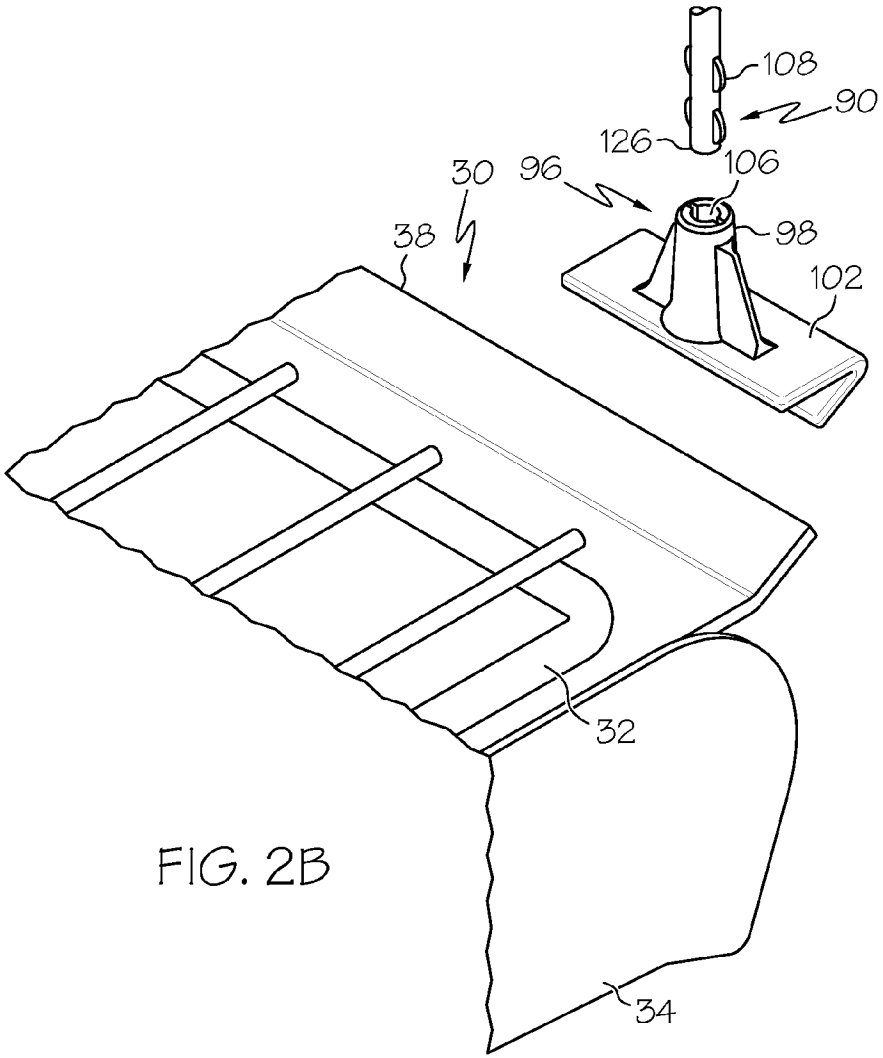
FIG. 2B is a front perspective view of a guide member, dividing member, and attachment member in accordance with an embodiment of the present invention.
Figure 2A:
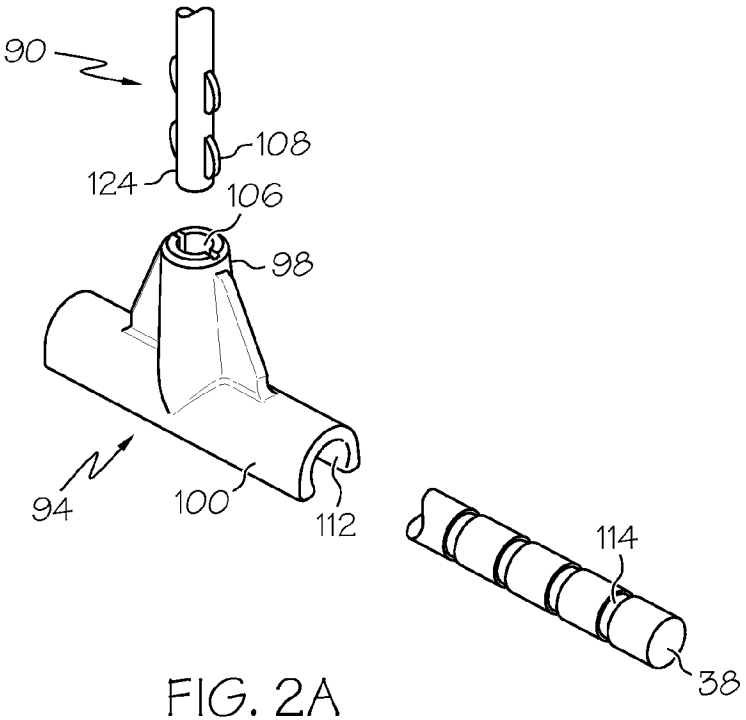
FIG. 2A is a front perspective view of a guide member, dividing member, and attachment member in accordance with an embodiment of the present invention.

As shown with particularly in FIGS. 2A and 2B, in one embodiment, the dividing member 92 terminates in respective ends 124, 126. In one particular embodiment, the respective ends 124, 126 may comprise a keyed structure 108, such that the respective ends 124, 126 are engageable with the engaging member 98. The dividing member 92 provides adjustable division of items on a shelving system 130. In one particular embodiment, the dividing member 92 provides adjustable division of items on a shelving system 130 into parallel tracks or channels such that items may be partitioned into orderly columns extending from the back to the front of the shelving system 130. The dividing member 92 may be made from any structurally suitable material, including plastics, metals, composites or the like. In one particular embodiment, the dividing member 92 may comprise 6 gage wire. In a particular embodiment, the dividing member 92 may include a coating, such as a powder and/or enamel coating. The coatings may provide color and/or related aesthetic features and may also provide resistance to corrosion and other environmental effects.

In another embodiment, the continuously adjustable device 90 for dividing items on a shelving system 130 may comprise a pair of guide members 94, 96. In one particular embodiment, the pair of guide members 94, 96 may comprise an engaging member 98. In one particular embodiment, the engaging member 98 may define at least one channel 106 through which the respective ends 124, 126 of the dividing member 92 are engageable with the engaging member 98. In another particular embodiment, the cross-sectional shape of the channel 106 may be substantially circular.

The pair of guide members 94, 96 may comprise at least one of a substantially arcuate-shaped member 100 and a substantially wedge-shaped member 102. In one particular embodiment, at least one of the substantially arcuate-shaped member 100 and the substantially wedge-shaped member 102 may be integral with the engaging member 98. In this way, at least one of the substantially arcuate-shaped member 100 and the substantially wedge-shaped member 102 is attachable to the supporting unit 30. In another embodiment, the engaging member 98 is substantially normal to at least one of the substantially arcuate-shaped member 100 and the substantially wedge-shaped member 102.

In one particular embodiment, the respective ends 124, 126 are engageable with the engaging member 98 through the channel 106 via frictional fit mechanism. In another particular embodiment, the channel 106 may comprise a keyed recess (not shown). In this particular embodiment, the keyed recess may be complementary to the keyed structure 108 such that the keyed structure 108 may engage the keyed recess.

In one embodiment, at least one of the substantially arcuate-shaped member 100 and the substantially wedge-shaped member 102 is attachable to the supporting unit 30. In one particular embodiment, at least one of the substantially arcuate-shaped member 100 and the substantially wedge-shaped member 102 is attachable to the supporting unit 30 via the plurality of attachment members 38 of the supporting unit 30. Specifically, in one embodiment, the substantially arcuate-shaped member 100 is attachable to the supporting unit 30 via the attachment members 38 with a snap-fit mechanism. Referring again to FIG. 2, in one particular embodiment, the substantially arcuate-shaped member 100 may comprise a keyed structure 112 and the attachment members 38 may comprise complementary recesses 114. In this way, the keyed structure 112 may engage the complementary recesses 114 of the attachment members 38. In another embodiment, the substantially wedge-shaped member 102 is attachable to the supporting unit 30 via the attachment members 38 with a frictional fit mechanism.

In one embodiment, the substantially arcuate-shaped member 100 and the substantially wedge-shaped member 102 are attachable to the attachment members 38 at continuously variable points along the length of the attachment members 38. More particularly, the substantially arcuate-shaped member 100 and the substantially wedge-shaped member 102 are attachable to the attachment members 38 at any point along the length of the attachment members 38. In this way, the continuously adjustable device 90 for dividing items on a shelving system 130 may provide adjustable division of items on a shelving system 130 into parallel tracks or channels, reducing any unnecessary gaps between items on the shelving system 130 and promoting maximization of merchandise facing and spacing. The pair of guide members 94, 96 may be made from any structurally suitable material, including plastics, metals, composites or the like.

Figure 3:
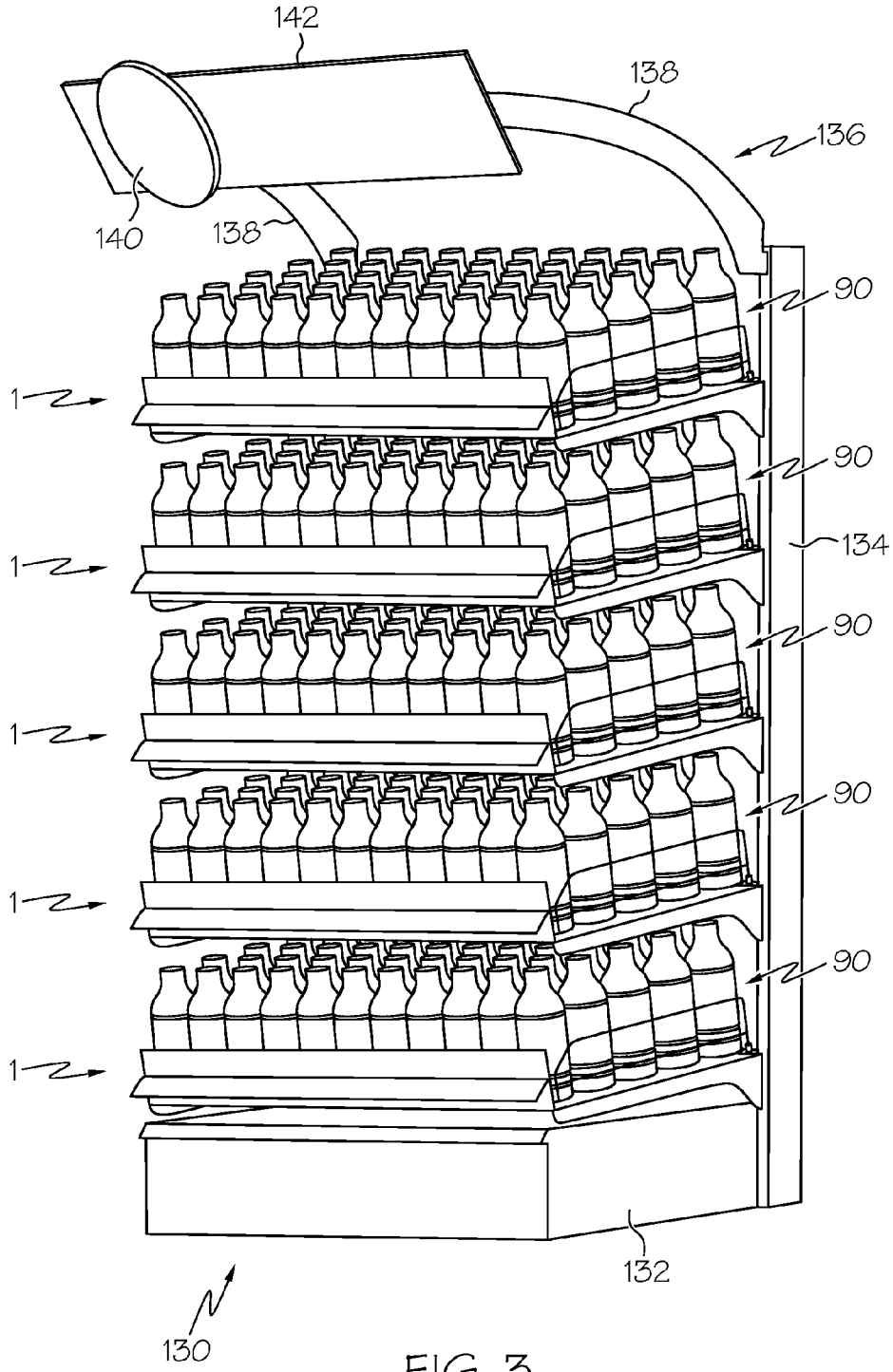
FIG. 3 is a front perspective view of a shelving system according to an embodiment of the present invention.
Figure 4:
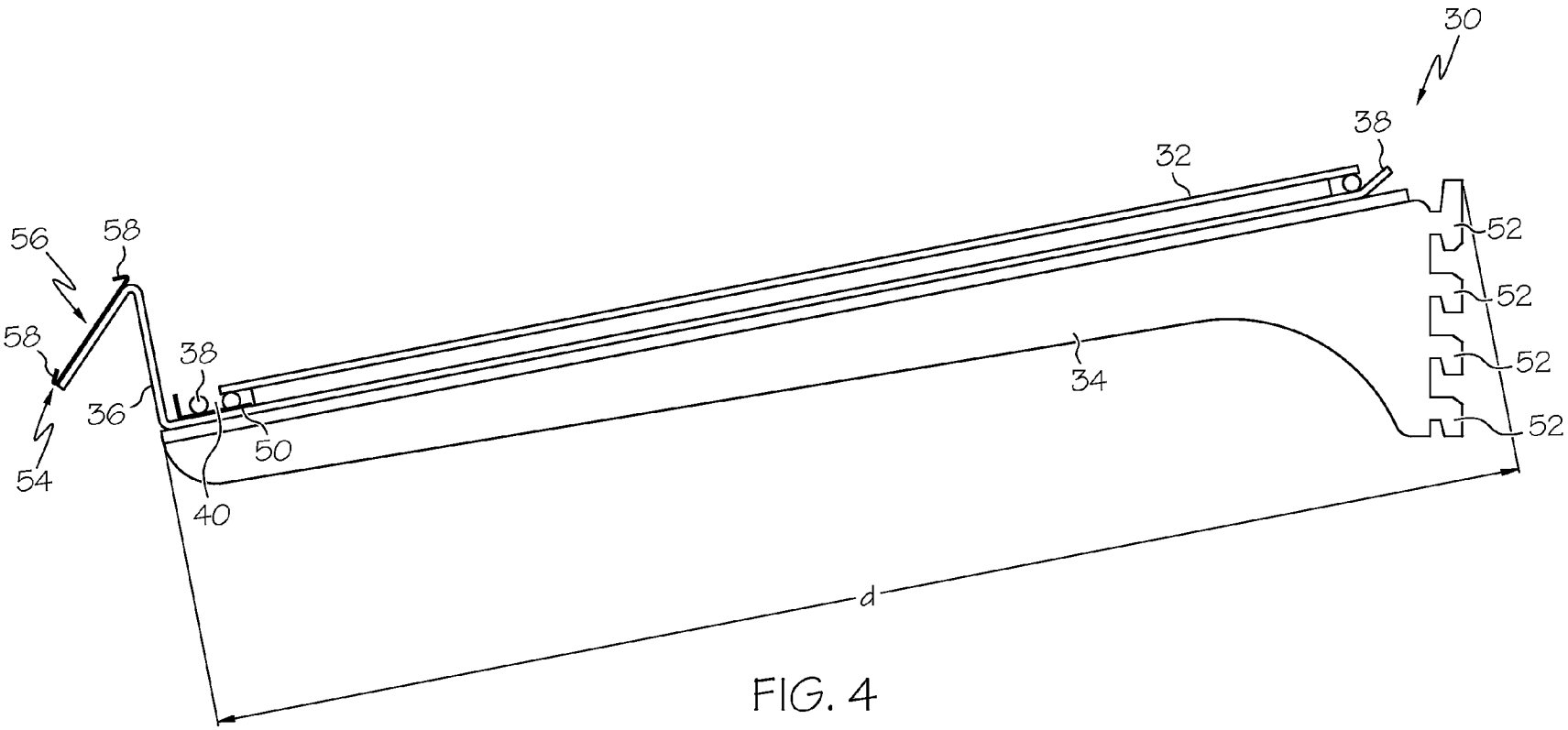
FIG. 4 is a side view of a retrofitting shelf according to an embodiment of the present invention.

As shown in FIG. 3, in another aspect, a shelving system 130 is disclosed. In one embodiment, the shelving system 130 may comprise a base 132, a plurality of substantially vertical members 134 attached to the base 132, and at least one retrofitting shelf 1 attached to the plurality of substantially vertical members 134. The vertical members 134 may define periodically-spaced slots (not shown). In one particular embodiment wherein the mounting brackets 34 provide detents 52, the detents 52 may engage the shelving system 130 such that the supporting unit 30 may be attached to the shelving system 130. Shelving system 130 may additionally include one or more overhead display members 136. In this particular embodiment, the overhead display member 136 may comprise at least one bracket 138, a panel 140 and a panel mount 142. In one particular embodiment, the bracket 138 is attachable to the vertical members 134. The panel mount 142 is attachable to the bracket 138. The panel mount 142 may define a channel (not shown) for displaying a panel 140 therein. In one particular embodiment, the bracket 138 extends upwardly from the vertical members 134 of the shelving system 130 such that the panel mount 142 extends substantially above the shelving system 130. The panel 140 may comprise text, graphics, images, and/or advertisements. In another embodiment, the shelving system 130 may comprise a gondola shelving system.

In another embodiment, the retrofitting shelf 1 attached to the vertical members 134 may comprise a supporting unit 30 and at least one continuously adjustable device 90 for dividing items on the shelving system 130. The continuously adjustable device 90 for dividing items on the shelving system 130 is attachable to the supporting unit 30 such that the items on the shelving system 130 may be adjustably divided. In this particular embodiment, the supporting unit 30 and the continuously adjustable device 90 of the retrofitting shelf 1 are as previously described.

In another embodiment, the shelving system 130 may further comprise a plurality of pivoting mechanisms 70 attachable to the plurality of mounting brackets 34 of the supporting unit 30 as previously described. The pivoting mechanisms 70 may provide selective rotation of the supporting unit 30, as previously described.

In yet another aspect, a method of displaying items on a shelving system 130 is disclosed. In one embodiment, the method of displaying items may comprise attaching a retrofitting shelf 1 to the shelving system 130 and placing items on the retrofitting shelf 1, such that the items are displayed. In one particular embodiment, the retrofitting shelf 1 is as previously described. In another particular embodiment, the items are placed on the supporting 30 of the retrofitting shelf 1.

For the purposes of describing and defining the present invention it is noted that the terms "about" and "substantially" are utilized herein to represent the inherent degree of uncertainty that may be attributed to any quantitative comparison, value, measurement, or other representation. The terms "about" and "substantially" are also utilized herein to represent the degree by which a quantitative representation may vary from a stated reference without resulting in a change in the basic function of the subject matter at issue.

The above description and drawings are only to be considered illustrative of exemplary embodiments, which achieve the features and advantages of the present invention. Modification and substitutions the features and steps described can be made without departing from the intent and scope of the present invention. Accordingly, the invention is not to be considered as being limited by the foregoing description and drawings, but is only limited by the scope of the appended claims.

What is claimed is:

1. A retrofitting shelf attachable to a shelving system, the retrofitting shelf comprising:

a supporting unit attachable to the shelving system, wherein the supporting unit comprises a support plate and a plurality of attachment members integral with a front surface and a back surface of the support plate;

a plurality of pivoting mechanisms attachable to the supporting unit, wherein the plurality of pivoting mechanisms provide selective rotation of the supporting unit; and at least one continuously adjustable device for dividing items on the shelving system, wherein the at least one continuously adjustable device is attachable to the supporting unit such that the items on the shelving system may be adjustably divided, and wherein the at least one continuously adjustable device for dividing items on the shelving system comprises:

a dividing member terminating in respective ends thereof; and a pair of guide members engageable with the respective ends of the dividing member and attachable to the supporting unit, such that when the pair of guide members is attached to the supporting unit the pair of guide members is in direct contact with the plurality of attachment members.

2. The retrofitting shelf of claim 1, wherein:

the support plate further comprises a pair of side surfaces substantially parallel to one another, and wherein the front surface of the support plate is substantially parallel to the back surface of the support plate and the front surface and the back surface of the support plate are substantially normal to the pair of side surfaces of the support plate such that the support plate is substantially rectangular; and the supporting unit further comprises a plurality of mounting brackets integral with the pair of side surfaces of the support plate and a stopper member integral with the front surface of the support plate.

3. The retrofitting shelf of claim 2, wherein the plurality of pivoting mechanisms are attachable to the plurality of mounting brackets.

4. The retrofitting shelf of claim 2, wherein the plurality of pivoting mechanisms provide selective rotation of the supporting unit such that support plate selectively rotates from about 0° to about 20°.

5. The retrofitting shelf of claim 2, wherein the pair of guide members comprises:

an engaging member defining at least one channel through which the respective ends of the dividing member are engageable with the engaging member; and at least one of a substantially arcuate-shaped member integral with the engaging member and a substantially wedge-shaped member integral with the engaging member, wherein the at least one of the substantially arcuate-shaped member and the substantially wedge-shaped member are attachable to the supporting unit.

6. The retrofitting shelf of claim 5, wherein the engaging member is substantially normal to the at least one of the substantially arcuate-shaped member and the substantially wedge-shaped member.

7. The retrofitting shelf of claim 5, wherein the cross-sectional shape of the at least one channel is substantially circular and wherein the cross-sectional shape of the dividing member is substantially circular.

8. The retrofitting shelf of claim 5, wherein the respective ends thereof are engageable with the engaging member through the at least one channel via frictional fit mechanism.

9. The retrofitting shelf of claim 5, wherein the at least one of the substantially arcuate-shaped member and-the substantially wedge-shaped member are attachable to the supporting unit via the plurality of attachment members of the supporting unit.

10. The retrofitting shelf of claim 9, wherein the substantially arcuate-shaped member is attachable to the supporting unit via the plurality of attachment members with a snap-fit mechanism.

11. The retrofitting shelf of claim 9, wherein the substantially wedge-shaped member is attachable to the supporting unit via the plurality of attachment members with a frictional fit mechanism.

12. A shelving system comprising:

a base;

a plurality of substantially vertical members attached to the base; and at least one retrofitting shelf attached to the plurality of substantially vertical members, wherein the at least one retrofitting shelf comprises:

a supporting unit comprising a support plate and a plurality of attachment members integral with a front surface and a back surface of the support plate; and at least one continuously adjustable device for dividing items on the shelving system, wherein the at least one continuously adjustable device is attachable to the supporting unit such that the items on the shelving system may be adjustably divided, and wherein the at least one continuously adjustable device for dividing items on the shelving system comprises:

a dividing member terminating in respective ends thereof; and a pair of guide members engageable with the respective ends of the dividing member and attachable to the supporting unit, such that when the pair of guide members is attached to the supporting unit the pair of guide members is in direct contact with the plurality of attachment members.

13. The shelving system of claim 12, wherein:

the support plate comprises a pair of side surfaces substantially parallel to one another, and wherein the front surface of the support plate is substantially parallel to the back surface of the support plate, and the front surface and the back surface of the support plate are substantially normal to the pair of side surfaces such that the support plate is substantially rectangular; and the supporting unit comprises a plurality of mounting brackets integral with the pair of side surfaces of the support plate and a stopper member integral with the front surface of the support plate.

14. The shelving system of claim 13, wherein the supporting unit further comprises a plurality of pivoting mechanisms attachable to the plurality of mounting brackets of the supporting unit, wherein the plurality of pivoting mechanisms provide selective rotation of the supporting unit.

15. The shelving system of claim 13, wherein the pair of guide members comprises:

an engaging member defining at least one channel through which the respective ends of the dividing member are engageable with the engaging member; and at least one of a substantially arcuate-shaped member integral with the engaging member and a substantially wedge-shaped member integral with the engaging member, wherein the at least one of the substantially arcuate-shaped member and the substantially wedge-shaped member are attachable to the supporting unit.

16. The shelving system of claim 15, wherein the respective ends thereof are engageable with the engaging member through the at least one channel via frictional fit mechanism.

17. The shelving system of claim 15, wherein the at least one of the substantially arcuate-shaped member and the substantially wedge-shaped member are attachable to the supporting unit via the plurality of attachment members of the supporting unit.

18. The shelving system of claim 17, wherein the substantially arcuate-shaped member is attachable to the supporting unit via the plurality of attachment members with a snap-fit mechanism.

19. The shelving system of claim 17, wherein the substantially wedge-shaped member is attachable to the supporting unit via the plurality of attachment members with a frictional fit mechanism.

20. A method of displaying items on a shelving system, the method comprising:

attaching a retrofitting shelf to the shelving system, wherein the retrofitting shelf comprises:

a supporting unit;

a plurality of pivoting mechanisms attachable to the supporting unit, wherein the plurality of pivoting mechanisms provides selective rotation of the supporting unit; and at least one continuously adjustable device for dividing items on the shelving system to the supporting unit, wherein the at least one continuously adjustable device is attachable to the supporting unit and wherein the at least one continuously adjustable device for dividing items on the shelving system comprises:

a dividing member terminating in respective ends thereof; and a pair of guide members comprising an engaging member defining at least one channel through which the respective ends of the dividing member are engageable with the engaging member and at least one of a substantially arcuate-shaped member integral with the engaging member and a substantially wedge-shaped member integral with the engaging member, wherein the at least one of the substantially arcuate-shaped member and the substantially wedge-shaped member are attachable to the supporting unit; and placing items on the supporting unit of the retrofitting shelf, such that the items are displayed.

* * * * *